United States Patent [19]

Christmann et al.

[11] 4,455,914

[45] Jun. 26, 1984

[54] PROCESS FOR THE PRODUCTION OF COMPACTED EXPLOSIVE DEVICES FOR AMMUNITION OR EXPLOSIVE CHARGES, ESPECIALLY THOSE OF A LARGE CALIBER

[75] Inventors: Wolfgang Christmann, Bergisch-Gladbach-Paffrath; Gerhard Lindner, Rosrath; Paul Lingens, Odenthal, all of Fed. Rep. of Germany

[73] Assignee: Dynamit Nobel Aktiengesellschaft, Troisdorf, Fed. Rep. of Germany

[21] Appl. No.: 394,643

[22] Filed: Jul. 1, 1982

Related U.S. Application Data

[63] Continuation of Ser. No. 98,948, Nov. 30, 1979, abandoned.

[30] Foreign Application Priority Data

Dec. 4, 1978 [DE] Fed. Rep. of Germany ..... 2852358

[51] Int. Cl.[3] ..... C06B 21/00; F42B 33/10

[52] U.S. Cl. ..... 86/1 R; 86/20 R; 86/20 B; 102/476; 264/3 R

[58] Field of Search ..... 86/1 R, 20 R, 20 B; 264/3 R; 102/476

[56] References Cited

U.S. PATENT DOCUMENTS

| | | | |
|---|---|---|---|
| 3,027,838 | 4/1962 | Meddick | 102/24 |
| 3,034,393 | 5/1962 | Lieberman et al. | 102/24 |
| 3,255,659 | 6/1966 | Venghiattis | 102/24 |
| 3,736,875 | 6/1973 | Bucklishch | 102/24 |
| 3,907,947 | 9/1975 | Newhaus et al. | 86/1 R |
| 3,924,510 | 12/1975 | Strunk et al. | 86/1 R |
| 4,014,963 | 3/1977 | Gawlick et al. | 86/20 R |
| 4,170,178 | 10/1979 | Diewald | 149/92 |
| 4,208,945 | 6/1980 | Davegårdh et al. | 86/20 R |
| 4,250,972 | 2/1981 | Diegmuller et al. | 264/3 R |

*Primary Examiner*—Edward A. Miller

*Attorney, Agent, or Firm*—Antonelli, Terry & Wands

[57] ABSTRACT

Explosive charges are compacted under low pressure to form a shaped preform which is then further compacted under higher pressure in a manner which provides a homogeneous finished product.

7 Claims, 6 Drawing Figures

PROCESS FOR THE PRODUCTION OF COMPACTED EXPLOSIVE DEVICES FOR AMMUNITION OR EXPLOSIVE CHARGES, ESPECIALLY THOSE OF A LARGE CALIBER

This is a continuation of application Ser. No. 098,948, filed Nov. 30, 1979, now abandoned.

The invention relates to a process for producing compacted explosive devices especially those suitable for large-caliber ammunition.

It is known to produce large-caliber ammunition with the aid of prefabricated, cast or pressed explosive devices or elements which are glued into the casings of the ammunition. If these prefabricated explosive devices, which already exhibit their final densities, were to be pressed into the casings, fissures and gaps could readily occur, especially along the interfaces between the explosive devices and other components, such as inert inserts for the guidance of detonation wave fronts, linings for hollow charges, primer charges, and walls of the casings. If several of such prefabricated explosive devices are glued into an ammunition casing, gaps also occur readily between such devices. Larger gaps in and on such explosive charges, however, are in most cases undesirable due to reasons of safety. In case of hollow charges, such larger gaps almost always result also in reduced efficiencies.

It is furthermore known from DOS [German Unexamined Laid-Open Application] 2,239,281 for the production of encased explosive devices to compact the explosive by means of a molding tool in the casing, open on one side, and to conduct, prior to compacting in the casing, an additional compacting or compressing step in a matrix, wherein the explosive is placed under pressure from that side which is opposed to the open side of the casing during the subsequent compacting step in the casing, in such a way that, in both pressing steps, the moving press tool is acting on mutually opposed sides of the explosive device or element. Both pressing steps are conducted under the same pressure. During the pressing process in the matrix, the pressed preform is obtained, the density of which is substantially equal to that of the finished explosive device and is slightly lower only in the zone of the end facing away from the press tool so that during the subsequent finishing pressing step in the casing the recompression takes place predominantly in this zone. Due to the fact that preliminary and final compacting are conducted under the same pressure, this recompression is extremely minor. The ensuing volume reduction of the pressed preform is very much lower than 1%. This mode of operation, though representing an improvement over the aforementioned mounting of prefabricated explosive devices by gluing, it does not as yet satisfy requirements regarding the snug contacting of the finished explosive devices against other components or also against one another and thus does not as yet satisfactorily avoid fissures or gaps in the finished ammunition or explosive charge.

The invention is based on the object of avoiding, in particular, the above-described disadvantages, in a process wherein, with a minimum of expense, a reliably flush contacting of the finished pressed explosive devices or elements against other components and/or against one another is attained. The compacted articles of explosive are utilized for ammunition, for example projectiles or warheads, or for explosive charges, e.g. mines. In particular, large-caliber ammunition or explosive charges are involved having a diameter of more than 60 mm. Furthermore, the articles of this invention are applicable particularly to ammunition or explosive charges with a hollow charge effect.

This object has been attained according to this invention by effecting a controlled further reduction in the volume of a pressed preform of explosive which is effected during the final compacting step under high pressure. For this purpose, one or more pressed preforms are manufactured under a comparatively low compacting pressure and a correspondingly lower density. These preforms are then introduced into a matrix or preferably directed into a casing wherein they remain after the finishing pressing step, for example a shell casing, and compacted in a further pressing step under high pressure to their final shape and density. Due to the low density of the pressed preform or preforms, still deformable, the preforms adapt themselves especially well to the configuration of the casing during the finishing compacting step. If several pressed preforms exist, then they are seamlessly joined to one another during the finishing compacting step, so that the tendency to crack formation in the final pressed product is especially low. Several pressed preforms of one piece of ammunition or explosive charge can be produced together by compacting in a single step, or they can also be subejcted to the finishing pressing step in succession, individually or in groups, by conducting a finishing pressing step after each introduction of a pressed preform or a group of pressed preforms into the matrix or casing. In the pressed preform or preforms, cavities, channels or the like can be left, in which can be embedded other components, such as, for example, the inert insert of a hollow charge, cables for ignition means, linings, or primer charges. The pressed preform or preforms of low density also enter readily into intimate or close contact with these other components. This results in a firm seating of the final pressed articles on these components and on the casing, without the occurrence of gaps or fissures. This ensures the reliably shape-mating contact. Additional advantages of the process according to the invention are the final production step, i.e. the finishing pressing step with a relatively small stroke, as well as the exiting of air during the first pressing step from the originally loose bulk of material to be compacted and from the pressed preform, which is still porous later on, during the final pressing step.

The low compacting pressure for producing the pressed preforms is understood to mean a pressure resulting in a volume reduction of the pressed preform during the finishing pressing step by at least 2% and at most 20%, preferably 5–10%. The percentage data are based on the volume of the finished pressed articles with final density. The volume reduction of the pressed preforms can be determined, for example, from the difference in density of the finished explosive devices and the density of the preform or preforms. This will be explained by using as an example the frequently employed, compactable explosive hexogen with an addition of 5% by weight of wax and 1% by weight of graphite. The hexogen was utilized in its usual particle distribution. The following dependency was found between the density of the pressed articles and the compacting pressure:

| Compacting pressure, bar | 180 | 250 | 500 | 750 | 950 | 1000 | 1500 | 2000 |
|---|---|---|---|---|---|---|---|---|

-continued

| | | | | | | | | |
|---|---|---|---|---|---|---|---|---|
| Density g/cm$^3$ | 1.40 | 1.47 | 1.58 | 1.63 | 1.65 | 1.66 | 1.68 | 1.69 |
| Reduction in volume, % | 21 | 15 | 7 | 4 | 2.5 | 1.8 | 0.6 | — |

The reduction in volume in % is calculated according to the equation $$\frac{\Delta V}{V_{final}} = \left(\frac{\rho_{final}}{\rho_{preform}} - 1\right) \cdot 100\%$$

wherein $\rho$ is the density.

The reduction in volume applies to a finishing compacting step under a final pressure of 2000 bar and is based on the final volume.

If, for example, the finished compacted explosive charge is produced under a pressure of 2000 bar, corresponding to a density of 1.69 g./cm$^3$, then the density of the pressed preform or preforms can amount, according to the invention, to about 1.40–1.66 g./cm$^3$, depending on the specific compacting pressure previously applied prior to the finishing compacting pressure. From the density differences, the volume reduction of the pressed preform or preforms can be calculated to be about 2–20%. Of course, the process of this invention can also be employed with the use of other explosives or explosive mixtures, e.g. with wax-stabilized octogen or mixtures of explosives with aluminum. The volume reduction of the pressed preforms during the final pressing step is then to be in all cases 2–20%, preferably 5–10%, which have shown in practice to give the best results.

The shape of the explosive bodies or explosive charges, especially of hollow charges, strongly deviates in most instances from a purely cylindrical configuration; in other words, these bodies or charges—as seen in the compacting direction—exhibit zones of very differing thicknesses. A density of the pressed articles which is uniform throughout all zones can then be achieved only if, in addition to the axial compacting, a radial flow of explosive components takes place, especially in case such an explosive article is to contain disk-shaped sections of a small thickness. In this case, the flowability of the customary explosives is insufficient to reach such a compensation. The result is that these zones of small thickness contain a higher density of explosive, produced during the compacting step, than the sections with a thicker explosive layer. As a further consequence, higher pressures occur during compacting in the sections where higher densities are encountered. These pressures, in an extreme case, can even extend into dangerous ranges of spontaneous ignition, although the average compacting pressure is far below this limit.

These situations can also occur if the process is conducted in a two-stage compacting operation with a slightly compacted pressed preform and a finished pressed article compacted to the final density, since already during the preliminary pressing step such thin, especially plate-shaped zones are compacted to higher densities then the thicker sections of the pressed preform.

To avoid such inhomogeneities in case of more complicated charges, the provision is made in a suitable embodiment of the invention wherein zones of the pressed preform are provided with dimensions that vary depending on the thickness of a particular zone of the preform, to produce pressed preforms which deviate in their configuration, i.e. not only in their dimensions, from that of the finished compacted articles. This procedure has proven to be especially advantageous in all those cases where the final shape of the pressed article is such that zones with especially high compacting pressures occur in the explosive during the customary finishing compacting step. This has the result that, prior to the finishing pressing step, the pressing tool is in full contact only in the zone of the thicker sections, whereas more or less large gaps, cavities, or the like are present in the zone of the thinner sections. During the finishing pressing step, the zone with a large explosive thickness which still has a relatively low density in the pressed preform, is compacted from the beginning of the pressing step, whereas the sections of a smaller thickness are more or less recompressed only after a corresponding movement of the press die and after elimination of the empty space between the press die and the thinner sections. Such empty spaces of predetermined dimensions can also be provided between adjoining pressed preforms, and with respect to components of another material, the charge casing, the matrix, or the like. These empty spaces have the result that the bulk of explosive adjoining these components is, in a controlled manner, recompressed to a lesser extent during the finishing pressing step. It is thus possible by an appropriate choice of the intermediate shape of the pressed preform in relation to the final shape of the finished pressed article to avoid improper local excess pressures during the finishing pressing step and density fluctuations in the finished pressed article.

The process of this invention will be described in greater detail below with reference to the embodiments illustrated in the drawings wherein:

FIGS. 1 through 6 show, in schematic views, longitudinal sections through articles disposed in the compacting tool and having varying shapes. Elements shown in an elevational view are characterized by an axially parallel shading. Identical elements bear the same reference numerals in all figures.

FIG. 1 shows a schematic view, partly in section, of an embodiment wherein a pressed preform with a recess is positioned in a compacting tool; whereas

FIG. 3 shows a schematic view of a formation of a pressed preform in a compacting tool; whereas

Figure 5:
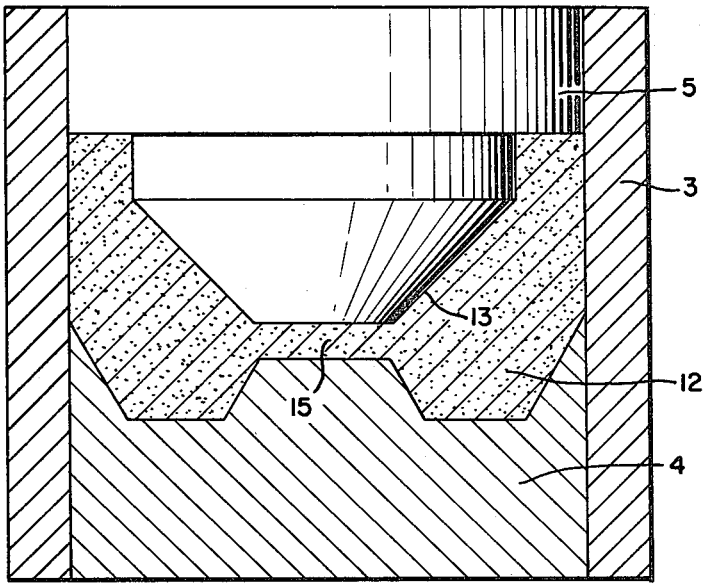
Figure 6:
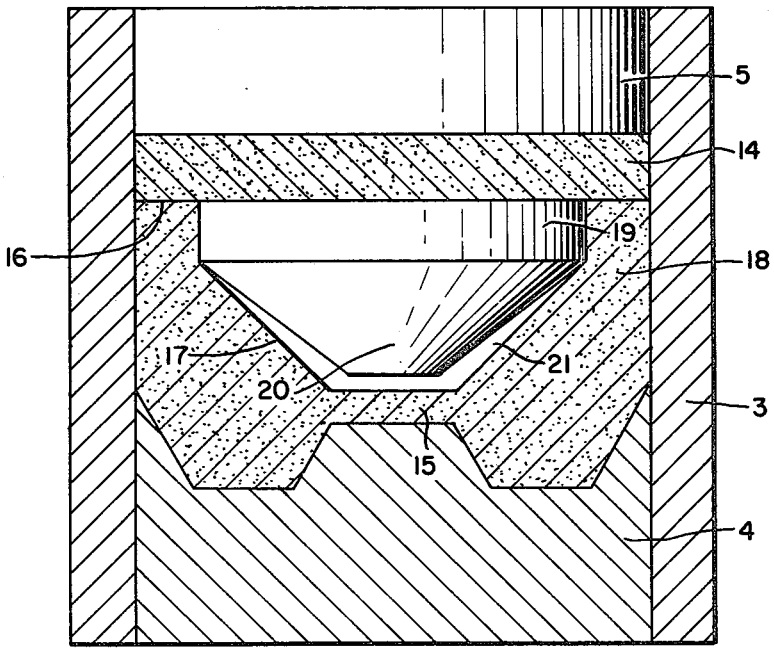

FIGS. 5 and 6, respectively, are schematic views partly in section, showing the initial production of a pressed preform of explosive material in a mold by compacting to provide a recess for a synthetic resin element and the final pressing step wherein the pressed preform, the synthetic resin element and an explosive disk are compacted together.

Figure 1:
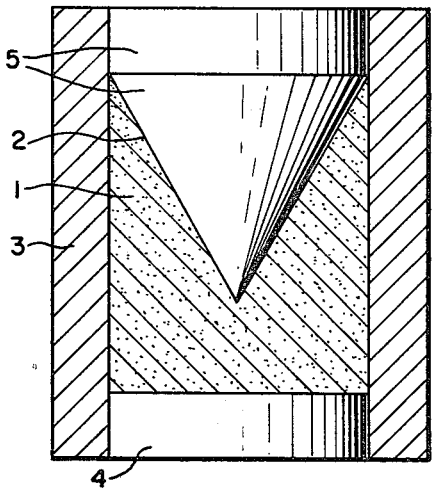
Figure 2:
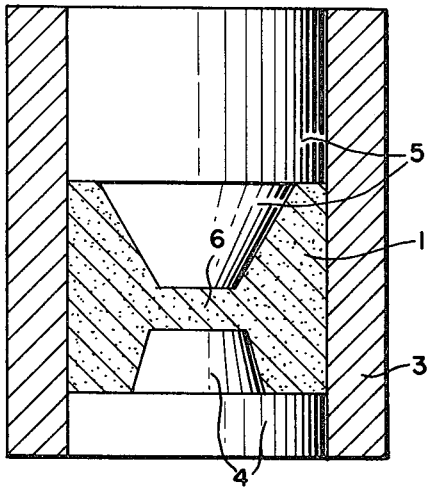
FIG. 2 shows a similar view of another embodiment wherein a preform with two recesses is positioned in a compacting tool.

The pressed article 1 shown in FIG. 1 has the coaxial, conical recess 2 and is arranged within the cylindrical matrix 3 between the bottom half 4 and the top half 5 of the compacting tool. On account of the recess 2, the thickness of the pressed article is—as seen in the axial direction—different, so that the solid particles, for a homogeneous compacting, must flow not only in the axial but also in the radial direction. This is true to an even greater extent if the pressed articles exhibit, for example, disk-shaped sections of a small thickness, for example the central zone 6 in FIG. 2 or the annular marginal zone 7 in FIGS. 3 and 4.

Figure 3:
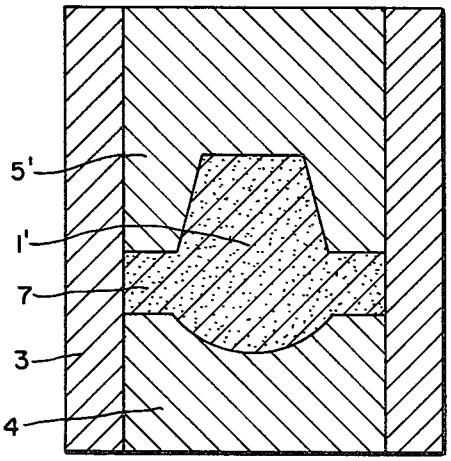
Figure 4:
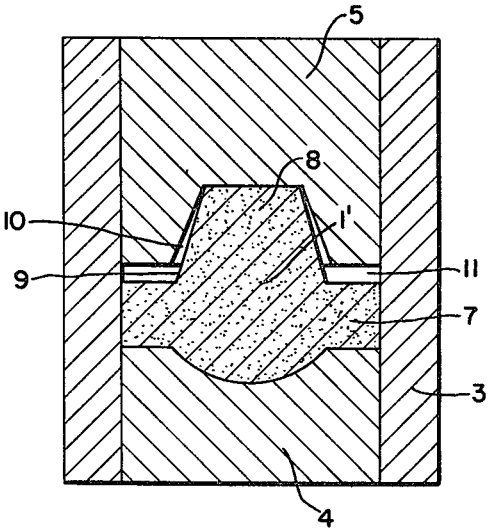
FIG. 4 shows a similar view of the pressed preform in another compacting tool during the finishing or final compacting step.

To avoid improper inhomogeneities in such cases, it is possible to impart to the pressed preform 1' a different shape than that to be exhibited by the finished pressed article, as shown in FIG. 3. The top half 5 of the mold shown in FIG. 4 is shaped in correspondence with the desired final shape of the finished pressed article. The top mold 5' utilized for the preliminary compacting step according to FIG. 3, in contrast thereto, is constructed so that those sections of the finished pressed article which have a small thickness are brought to their final dimensions almost entirely already during the preliminary pressing step; whereas those sections which are relatively thick in the finished pressed article are obtained with a larger excess dimension. As a result—as shown in FIG. 4—the top mold 5, prior to the finishing pressing step, is in full contact only in the zone of the thick sections 8, whereas a wedge-shaped air gap 10 is present in the zone of the declining conical flank 9 of the pressed preform 1' and a planar-parallel air gap 11 exists in the zone of the plate-shaped section 7. During the finishing pressing step, the zone 8 of large explosive thickness, obtained in the pressed preform 1', with a relatively low density in correspondence with the above-described operations, is compacted already at the beginning of the pressing step, while the gaps 10, 11 are closed and filled during the course of the movement of the press die. Thus, the zones therebelow, obtained in the pressed preform with a relatively high density, are correspondingly less recompressed. With an appropriate dimensioning of the gaps, the objective is attained that density fluctuations in the finished pressed article and excess pressures during the finishing pressing step in the thinner zones are practically eliminated.

Of course, such a gap can also be provided on the underside of the pressed preform or, for example, also on both sides. Also, this gap need not have a wedge-shaped or planar-parallel form, but rather can exhibit any other suitable configuration in correspondence with the structural character of the charge.

EXAMPLE 1

A projectile with a projectile case cylindrical at least in the zone of the explosive charge and with a profiled bottom portion in contact with the charge was tested with the aid of 2 pressed preforms of hexogen with 5% by weight of wax. An inert insert of, for example, a synthetic resin such as polyamide or polyethylene, was introduced into the explosive material to guide the detonation waves. At the rim of the pressed preforms, toward the wall of the case, an insulated wire for transmitting the ignition impulse was inserted in a groove worked into the pressed preforms.

The pressed preforms were of such a construction that, when joined together, the cavity was left free for the inert insert. These preforms were manufactured under a compacting pressure of 500 bar so that their density, with 1.58 g./cm$^3$ on the average, was merely 94% of the final density of 1.68 g./cm$^3$ of the pressed article produced under a compacting pressure of 1500 bar. This corresponds to a volume reduction of 6% during the finishing pressing step.

By means of the finishing pressing step at 1500 bar directly in the projectile case, a fissure-free explosive device was obtained—as demonstrated by the projectile, sawed in two—this explosive device surrounding the introduced components without any gap and being in perfect contact with the projectile case. The two pressed preforms had joined together seamlessly so that the parting line was no longer noticeable.

In contrast thereto, by manufacturing the pressed preforms under a compacting pressure of 1200 bar, thus bringing the explosive material to a density of 1.67 g./cm$^3$, corresponding to 99% of the final density, a volume reduction of 1% was still obtained during the finishing pressing step under a compacting pressure of 1500 bar. After the finishing pressing step directly into the projectile case, no adherence to the wall existed. The inserted ignition wire was no longer surrounded, and the former parting line of the pressed preforms proved to be a weak point where the explosive device tended to break apart. Additionally, the explosive device of the projectile was traversed by a fissure.

EXAMPLE 2

An explosive device of hexogen with 5% by weight of wax and having an irregular shape, but being of a rotationally symmetrical form and having a cylindrical outer surface, was to be produced as a pressed preform and, in a second compacting step, as a finished pressed article. A synthetic resin component was to be embedded in this pressed explosive article.

In the preliminary compacting step, the pressed preform 12 shown in FIG. 5 was produced in a matrix 3, using a bottom mold and a top mold shaped in correspondence with the desired configuration of the surfaces of the pressed preform 12 and of the recess 13 for the synthetic resin element, respectively. Furthermore, in a press mold not illustrated, an explosive disk was manufactured analogously to the disk 14 in FIG. 6 as a pressed preform. The compacting pressure for producing these two pressed preforms was 300 bar. The recess 13 for the intended synthetic resin element was exactly produced by pressing in the pressed preform 12, so that this synthetic resin element fitted into the recess with a minimum of clearance.

During the finishing pressing step analogously to FIG. 6, the bottom mold 4 was inserted in the matrix 3, and the pressed preform 12, then the synthetic resin element, the explosive disk, and finally the top mold 5 were applied. A gap between the pressed preform and the synthetic resin element was nonexistent in this case—in a deviation from FIG. 6—due to the exact adaptation of recess 13 of the pressed preform 12 to the shape of the synthetic resin element. Thereupon the finishing pressing step was executed under a pressure of 1300 bar.

A section through the thus-manufactured component showed that undesirably high pressures had occurred in the zone of the narrow region 15 during the finishing pressing step. Thereby the tip of the synthetic resin element was deformed, and the intermediate layer of explosive was compacted to undesirably high densities. The strong pressure on the synthetic resin element in its central zone furthermore had the result that this element tended to expand after relief of the pressure, so that the finished pressed article tended to crack open along the previous seam between the explosive disk and the explosive element 12—corresponding to the seam 16 in FIG. 6.

These disadvantages were avoided in accordance with the invention by providing that, in accordance with FIG. 6, the recess 17 in the pressed preform 18 was no longer produced to be in conformance with the outer contour of the synthetic resin element 19 with tip 20; rather, there was left a wedge-shaped gap 21 between the pressed preform and the synthetic resin element. The pressed preform 18 was compacted in such a way that the density of the explosive layer in the narrow zone 15 correspond almost to the finally desired density. During the finishing pressing step, the explosive disk 14 and thus the rim of the pressed preform 18 and the synthetic resin element 19 were pressed downwardly. Thus, during the course of the compacting step, the gap 21 between the synthetic resin element 19 and the pressed preform 18 was closed by pressure, beginning with its pointed end, and thereupon the explosive layer was compacted which was disposed therebelow.

The volume reduction is 12% in this procedure. As a result, the outer portions of the explosive preform 18 are more strongly compacted during the finishing pressing step than the portions located in the proximity of its axis. This is desirable, inasmuch as, due to their shape, these outwardly located zones were imparted with a lower density during the preliminary pressing step than the zones arranged close to the axis. Accordingly, a qualitatively perfect charge has thus been produced, which shows no fissures and contains no zones of excessive densities. A flawless bond is established between the explosive disk 14 and the explosive device 18. The synthetic resin insert 19 shows no deformations.

The process of this invention can, of course, also be realized with pressed articles of a different construction, in which case the shape of the intended cavity must be adapted to the respective conditions and need not be a wedge shape, as in the present example. In this way, homogeneous explosive charges are obtained having a shape-mating contact with the case, the inert insert, the hollow-charge insert, etc. Thereby the hollow charge efficiency and the safety are increased, in particular, and the scattering or variation of the resultant data is reduced.

The compacting pressures used for the two different compacting steps are chosen according to the desired reduction in volume and the properties of the explosive. The lower limit for the low compacting pressure is determined by a stability of the pressed preform or preforms to be handable, whereas the upper limit of the high compacting pressure is given by the fact that when applying still higher pressures no further reduction in volume is achieved. In general the low compacting pressure will be between about 500 to 1000 bar and the high compacting pressure between about 1300 to 2500 bar, prefarably up to 2000 bar.

We claim:

1. A process for the production of compacted explosive devices for large caliber ammunition or explosive charges which comprises compacting an explosive material under a low compacting pressure to form a pressed preform with a shaped configuration deviating from a final configuration of a finished pressed explosive device which is obtained by further compacting of the pressed preform, said pressed preform and said finished pressed explosive device having zones of differing thicknesses, further compacting the pressed preform in a finishing compacting step under a high compacting pressure to reduce the volume of the preform by 2 to 20%, the zones of the pressed preform of a smaller thickness being provided with dimensions almost the same as that of the finished pressed explosive device and the zones of the pressed preform having a larger thickness being formed with a larger excess dimension and during the finishing compacting step, a greater recompression being effected in a controlled manner in the zones of the larger thicknesses than in the zones of the smaller thicknesses to provide a homogeneous finished pressed explosive device.

2. A process according to claim 1, wherein the volume of the pressed preform is reduced under the high compacting pressure by 5–108.

3. A process according to claim 1, wherein the pressed preform is initially compacted under a low compacting pressure of between about 500 to 1,000 bar and, thereafter, during the finishing compacting step, the pressed preform is subjected to a high compacting pressure between about 1,300 to 2,500 bar.

4. A process according to claim 3, wherein the finishing compacting step is effected at a pressure of not more than 2,000 bar.

5. A process according to claim 1, wherein a plurality of pressed preforms of explosive material are formed into a finished explosive device, the pressed preforms initially being compacted under said low compacting pressure and, thereafter, in an assembled mating arrangement, the pressed preforms are subjected to said high compacting pressure to effect further reduction in the volume of each of said preforms.

6. A process for the production of a compacted explosive device which comprises:

compacting an explosive material at a first pressure of between about 500 to 1,000 bar within an ammunition casing positioned in a press mold to form a pressed preform of said explosive material within said casing; and further compacting said preform within said casing at a second pressure higher than said first pressure so that the volume of the preform is reduced by 2–20% and the resulting compacted explosve device is free of fissures; the pressed preform and the compacted explosive device having zones of differing thicknesses and during the compacting of the pressed preform under the first pressure, the zones of the pressed preform of a smaller thickness being produced almost with the same dimensions as the finished pressed explosive device and the zones having a larger thickness being produced with a larger excess dimension and during the further compacting step, a stronger recompression being effected in a controlled manner in the zones of larger thicknesses than in the zones of smaller thicknesses of the pressed preform in order to obtain a homogeneous, finished, pressed explosive device.

7. A process according to claim 6, further comprising forming at least one other pressed preform of explosive material in a press mold at low compacting pressure, positioning said at least one other preform in said ammunition casing prior to said further compacting of said one preform, and then compacting all preforms within said casing at said second pressure.

* * * * *